US006942378B2

(12) United States Patent
Hayek et al.

(10) Patent No.: US 6,942,378 B2
(45) Date of Patent: Sep. 13, 2005

(54) DETENT ESCAPEMENT FOR TIMEPIECE

(75) Inventors: Nicolas Georges Hayek, Meisterschwanden (CH); Thierry Conus, Lengnau (CH); Andréas Cabezas Jurin, Yverdon-les-Bains (CH)

(73) Assignee: Montres Breguet SA, L'Abbaye (CH)

( * ) Notice: Subject to any disclaimer, the term of this patent is extended or adjusted under 35 U.S.C. 154(b) by 0 days.

(21) Appl. No.: 11/000,370

(22) Filed: Dec. 1, 2004

(65) Prior Publication Data

US 2005/0122847 A1 Jun. 9, 2005

(30) Foreign Application Priority Data

Dec. 4, 2003 (EP) ..... 03027910

(51) Int. Cl.[7] ..... G04B 15/00; G04C 5/00
(52) U.S. Cl. ..... 368/127; 368/131; 368/132
(58) Field of Search ..... 368/124–133

(56) References Cited

U.S. PATENT DOCUMENTS 2,705,048 A * 3/1955 Gaston ..... 368/101
2,907,168 A * 10/1959 Zen-Ichi ..... 368/130
2,964,901 A * 12/1960 Beyner et al. ..... 368/133
2,971,324 A * 2/1961 Beyner ..... 368/132
3,137,122 A * 6/1964 Dinerstein et al. ..... 368/127
3,538,705 A * 11/1970 Perry ..... 368/125
4,122,665 A * 10/1978 Giger ..... 368/327
6,301,981 B1 * 10/2001 Oechslin ..... 74/1.5

FOREIGN PATENT DOCUMENTS

CH 258 A 2/1889
CH 3 893 A 1/1892
CH 64 175 D 1/1977
FR 1 009 853 A 6/1952

OTHER PUBLICATIONS

European Search Report, completed Jul. 13, 2004.

* cited by examiner

*Primary Examiner*—Vit W. Miska
(74) *Attorney, Agent, or Firm*—Griffin & Szipl, P.C.

(57) ABSTRACT

The detent escapement includes a wheel 2 fitted with teeth 3, a roller 4 fitted with an impulse pallet stone 5, a blocking member in the form of a lever 6 hinged on a pin 8. The first and second arms 9 and 10 of the lever respectively carry a locking pallet stone 7 and a first actuating finger 11. An elastic member 12 is mounted on the roller 4, said member carrying a second actuating finger 14 capable of driving the first finger 11 when the roller 4 rotates in a first direction a to actuate the blocking member 6 and to move around said first finger 11 without driving it, when the roller 4 rotates in a second direction b opposite to the first. The elastic member 12 is a spring of great length including a plurality of turns 15 wounded about a centre 16.

16 Claims, 7 Drawing Sheets

DETENT ESCAPEMENT FOR TIMEPIECE

This application claims priority from European Patent Application No. 03027910.3 filed Dec. 4, 2003, the entire disclosure of which is incorporated herein by reference.

The present invention relates, according to a first embodiment, to a detent escapement for a timepiece, including an escapement wheel, fitted with teeth, a roller secured to a balance, said roller being fitted with an impulse pallet stone, a blocking member in the form of a lever hinged on a pin, the first and second arms of said lever respectively carrying a locking pallet stone and a first actuating finger, and an elastic member mounted on the roller and carrying a second actuating finger capable of driving the first finger when the roller rotates in a first direction to actuate the blocking member and to move around without driving said finger when the roller rotates in a second direction opposite to the first.

A detent escapement answering the above description has already been proposed. A diagram thereof can be found in FIGURE 402 of the work by George Daniels entitled "I'Art de Breguet" (London 1975). The system disclosed shows a pivoting detent chronometer escapement thus using a blocking member in the form of a lever hinged on a pin. One arm of the lever is fitted with a locking pallet stone cooperating with the teeth of the escapement wheel. The other arm cooperates with a spring device mounted on the roller secured to the balance. This spring device is a very short strip able both to actuate the lever when the roller rotates in one direction and to remain without any effect on said lever when the roller rotates in the opposite direction. Therein lies the principle of every detent escapement in which the impulse is only given to the balance once by oscillation during which the escapement wheel rotates through one angular step whereas, in lever escapements, said wheel advances through a half step at each vibration. One of the advantages provided by the detent escapement can be seen here, since the energy wasted following the escapement wheel's inertia only occurs once per oscillation instead of once per vibration.

A detent escapement including an elastic member mounted on the roller, said member actuating, in one rotational direction of the roller, a detent able to release one tooth of the escapement wheel, is shown in FIGURE 352*b* of the work of Prof. Glaser entitled: "Handbuch des Chronometrie und Uhrentechnik". This escapement, already proposed by F. Berthoud in 1770, is for a chronometer. The device uses a relatively short strip spring mounted on the roller by means of a sort of bow that rotates with it. The end of the strip cooperates with the end of the detent, which is not actually a lever but a flexible stem carrying a locking pallet stone.

From the two embodiments that have just been briefly described hereinbefore, a construction suited to timepieces of large dimensions will be retained, such as chronometers or marine chronometers. These timepieces are appreciated because of their great accuracy, for which reason a detent escapement, itself well known for its great accuracy, is very often used. The large dimensions of the timepieces in question enables large balances to be used, having a large energy reserve and high torque. This thus enables the significant force presented by the strip springs of the aforecited prior art to be overcome and in general conventional constructions using a gold spring. In the detent escapement, it is known that on a first vibration the spring must be tightened to release the locking pallet stone and that on the second vibration, said spring must be let down in order for it to move around the detent which is not then being actuated.

It is an object of the present invention to propose a timepiece of small dimension, for example a wristwatch, which is fitted with a detent escapement to replace, for example, the conventional lever escapement and to benefit from the advantages provided by this escapement. It will be understood however, that using the prior known techniques described hereinbefore would lead to failure since the energy produced by the balance of a wristwatch is much less than that produced by a chronograph watch, this balance thus proving incapable of overcoming the forces acting on the detent.

Thus the timepiece of the present invention, in addition to answering the definition of the first paragraph of this description, is characterised in that the elastic member is a spring including a plurality of turns wound around a centre, this elastic member being able to take, for example, the form of a spiral spring. Thus, in the detent escapement of the invention, the short spring of the prior escapements has been replaced by a much longer spring requiring much less actuation effort by the balance, which is responsible for bending it.

The present invention also relates, according to a second embodiment, to a detent escapement for a timepiece including an escapement wheel fitted with teeth, a roller secured to the balance, said plate being fitted with an impulse pallet stone and a first finger, a blocking member hinged on a pin, a first arm of said lever carrying a locking pallet stone, said lever including an elastic member carrying a second actuating finger able to be driven by the first finger when the roller rotates in a first direction to actuate the blocking member, and to move around without driving said first finger when the roller rotates in a second direction opposite to the first.

This second embodiment differs from the first embodiment in that the elastic member is not longer arranged on the roller but on the blocking member. The principle remains the same for the rest, namely proposing a new detent escapement able to be fitted to a watch of small dimensions, for example a wristwatch, this new escapement also including an elastic member of large length to minimise the actuation effort required by the balance.

Thus the timepiece of the present invention, in addition to answering the definition hereinbefore relating to the second embodiment, is characterised in that the elastic member includes, in a first variant, a serpentine spring and in a second variant, a spiral spring. Here too, it should be repeated, the short spring of known escapements has been replaced by a much longer spring which requires much less actuation effort by the balance, which is responsible for bending it.

The invention will be explained in detail hereinafter by two embodiments given by way of example, these embodiments being illustrated by the annexed drawings, in which.

Figure 1:
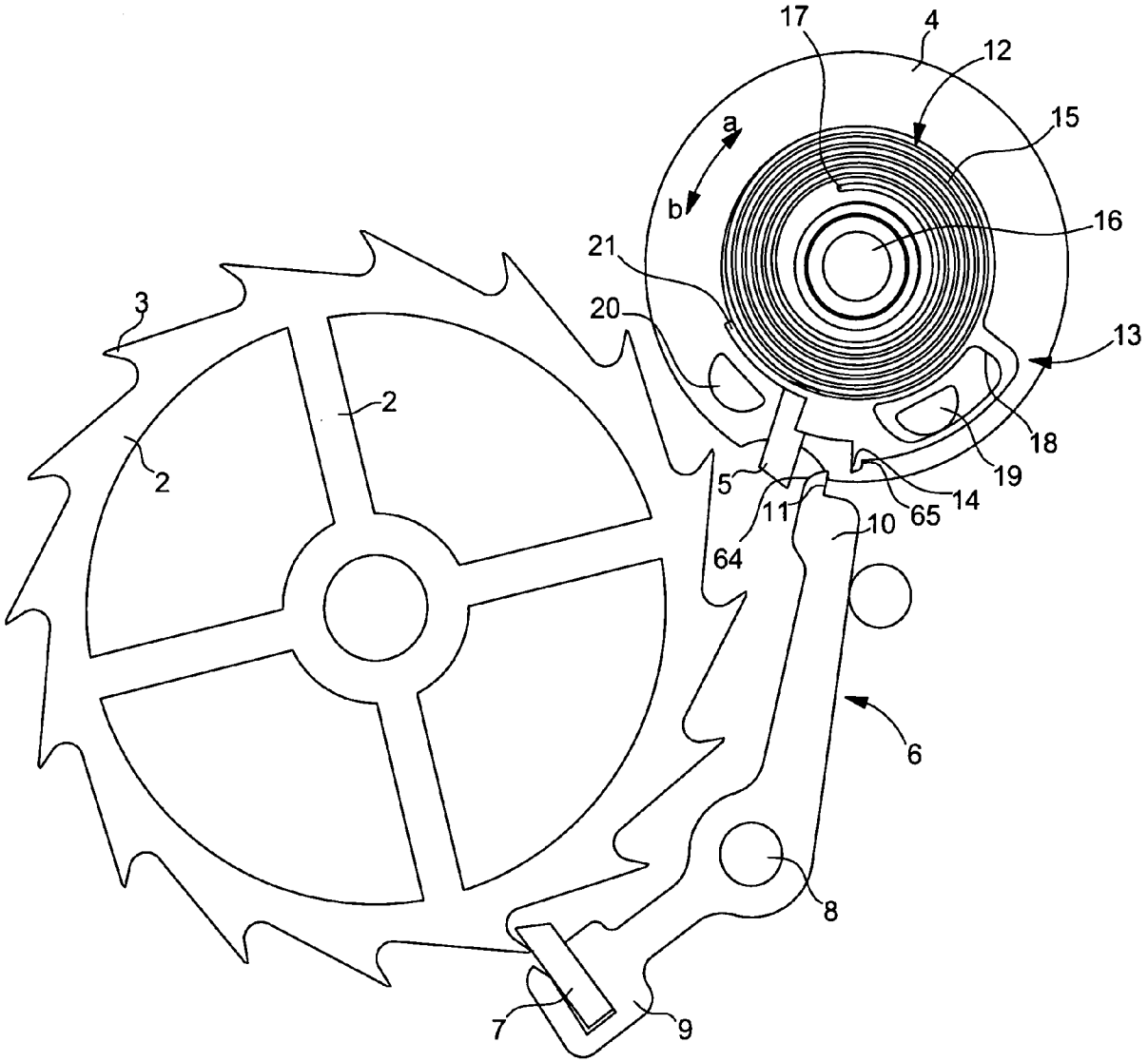
FIG. 1 is a plan view of the first embodiment of the invention.
Figures 2, 3:
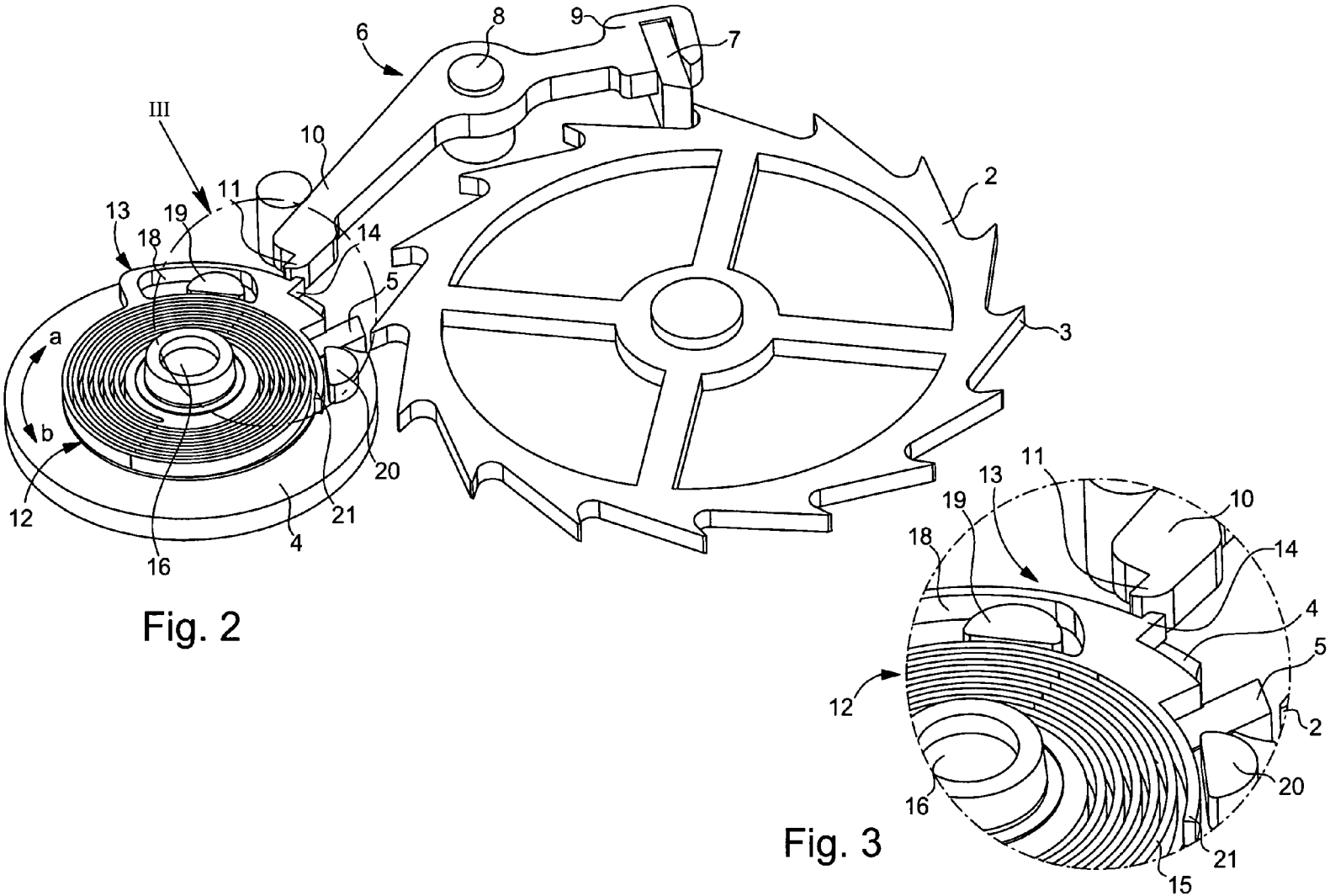
FIG. 2 is a perspective view of the embodiment shown in FIG. 1.
FIG. 3 is an enlargement of zone III of FIG. 2.
Figure 5:
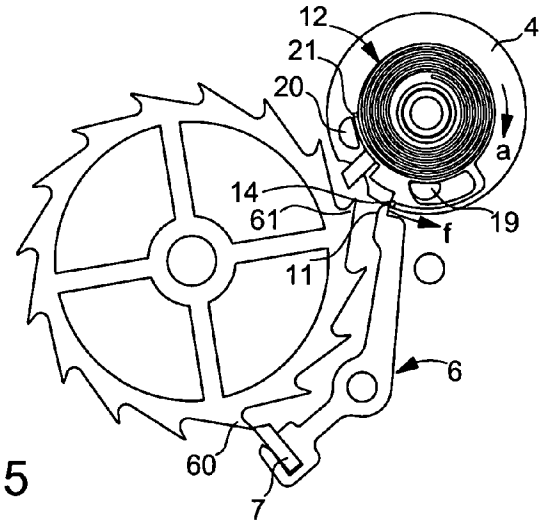
FIGS. 4 to 11 are plan views of the first embodiment of the invention explaining the different operating phases of the escapement illustrated in FIGS. 1 to 3.

The first embodiment of the invention is illustrated in FIGS. 1 to 11. The detent escapement includes an escapement wheel 2 fitted with teeth 3. Although not shown, the escapement wheel is driven by the gear train of the watch, which receives its driving force from the barrel. The Figures show a roller 4 mounted on the balance pin (not shown). Roller 4 is fitted with a pallet stone 5 receiving impulses from teeth 3 of wheel 2. The system also shows a blocking member 6 hinged on a pin 8. The blocking member includes a first arm 9 carrying a locking pallet stone 7 and a second arm 10 carrying a first actuating finger 11. Locking pallet stone 7 cooperates with teeth 3 of wheel 2. An elastic member 22 is mounted on roller 4. This elastic member 12 carries a second actuating finger 14, which is able to drive first finger 11 when roller 4 rotates in a first direction a in order to actuate blocking member 6 and to move around said first finger 11, without driving it, when roller 4 rotates in a second direction b opposite to the first.

As already discussed hereinbefore, the originality of the present invention lies in elastic member 12, which will be enable a detent escapement to be fitted to a watch of small dimensions. This is possible if the elastic member is a spring including a plurality of turns 15 wound about a centre 16. It is thus a very long spring, that is extremely flexible and which requires a minimum effort from the balance that actuates it. This spring may take several forms. A strip wound around itself about a fixed point and held in one plane will preferably be chosen, like a spiral spring 12, this winding or coil being able, however, to take a different shape, for example a square or a rectangle.

Spiral spring 12 shown in FIGS. 1 to 11 is mounted coaxially to a pin 16, which carries roller 4 and the balance (not shown). The inner end 17 of spiral spring 12 is fixed to pin 16 which carries roller 4. The outer end 13 of spiral spring 12 carries the aforementioned second actuating finger 14, said second finger emerging into the environment of said outer end.

FIGS. 1 to 11 also show that outer end 13 of spiral spring 12 and roller 4 include retaining means implemented to limit the shake of second finger 14 and to hold spiral spring 12 in limits allowing first finger 11, carried by blocking member 6, to respectively be driven or to move around. These retaining means will now be described.

Roller 4 carries a first pin 19 around which there is engaged, with clearance, an opening 18 made in outer end 13 of spiral spring 12. Roller 4 also carries a second pin 20 against which a tongue 21, ending outer end 13 of spiral spring 12, is able to abut, said outer end 13 including in order, and towards its end, opening 18, second finger 14 and tongue 21.

The operation of the detent escapement will now be described in detail with reference to FIGS. 4 to 11, which illustrate different phases of operation.

Figure 4:
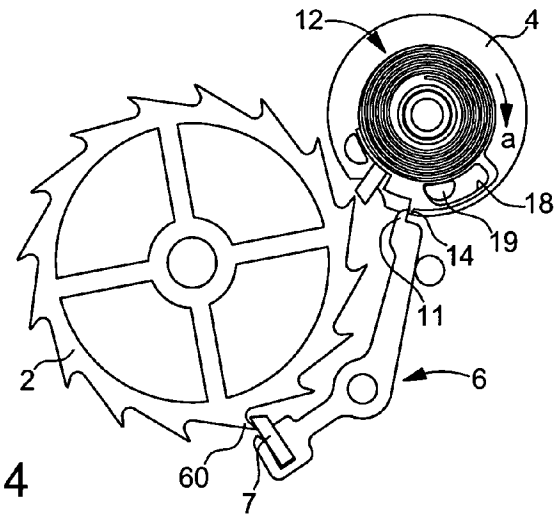

In FIG. 4, roller 4 is rotating in the direction arrow a. Pin 19 is abutting against the left side of the bottom of opening 18, which has the effect of tightening spiral spring 12 and bringing second finger 14 of spiral spring 12 into contact with first finger 11 of blocking member 6. At this moment, locking pallet stone 7 of blocking member 6 is completely engaged in tooth 60 of escapement wheel 2, which is locked.

Continuing its travel in the direction of arrow a, second finger 14 (FIG. 5) drives first finger 11 of blocking 6 and causes the latter to tip bringing locking pallet stone 7 to the limit of the recess of tooth 60. It will be noted here that during said driving, first finger 11 exerts a force f directed towards the right of the Figure on second finger 14, said force tending to rotate spiral spring 12 in an anti-clockwise direction around first pin 19. Second pin 20 prevents this rotation since tongue 21 at the end of spiral spring 12 is abutting precisely against said second pin 20.

Figure 6:
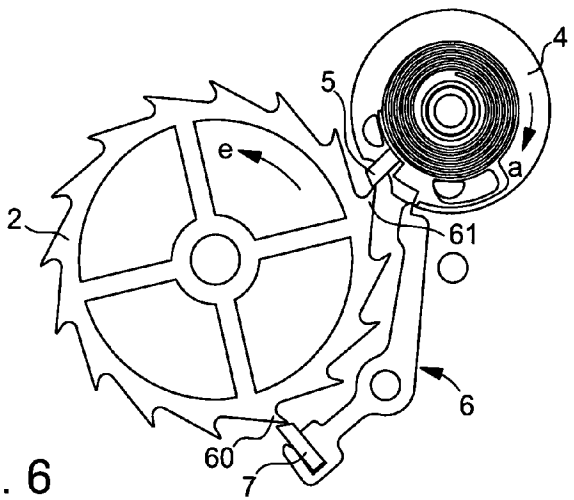

As can be seen in FIG. 6, escapement wheel 2 is free and rotates in the direction of arrow e. Its tooth 61 comes into contact with pallet stone 5 of plate 4, which has the effect of giving an impulse to roller 4 and the balance which is linked thereto.

Figure 7:
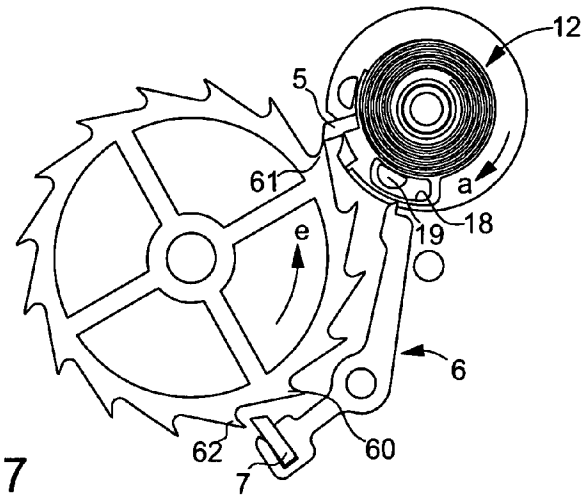

The end of the impulse is shown in FIG. 7. Tooth 61 is on the point of leaving pallet stone 5 and the blocking member is returning to its rest position, locking pallet stone 7 being inserted into the space separating teeth 60 and 62. The return of blocking member 6 to its rest position is achieved by means which are not shown in the drawing. These could be a simple strip spring or a spiral spring as described for example in the work by Huguenin, Guye and Gauchat entitled "Echappements et Moteurs pas à pas" in Figure 17-4. The situation of FIG. 7 also shows that spiral spring 12 is let down, pin 19 no longer pressing against the left side of the bottom of aperture 18.

Figure 8:
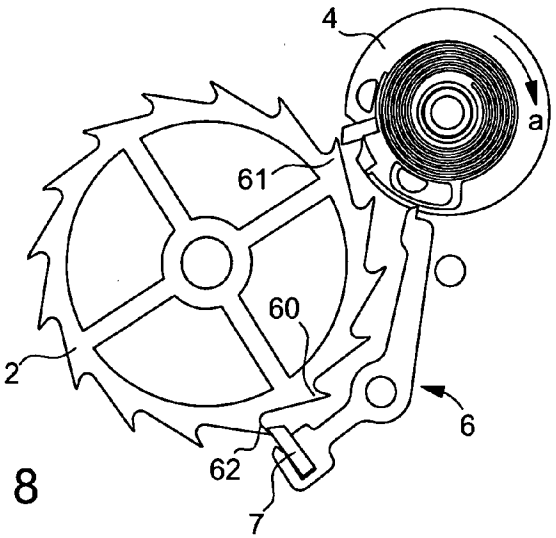

FIG. 8 shows locking pallet stone 7 coming into contact with tooth 62 of wheel 2 which is stopped. Roller 4 continues its travel in the direction of arrow a and starts to go through its additional free arc until completion of its first vibration.

Figure 9:
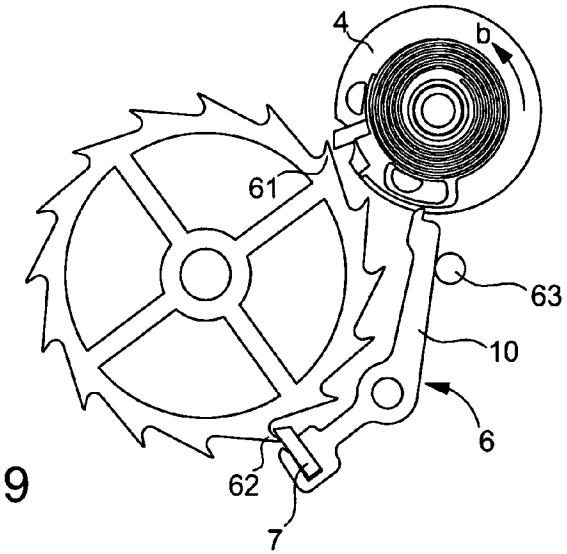

The additional reverse arc is being completed as FIG. 9 shows. The roller is rotating in the direction of arrow b and is close to the end of the second vibration. Blocking member 6 is in the rest position, returned as it is by a return spring that is not illustrated but which was discussed with reference to FIG. 7. Locking pallet stone 7 rests at the bottom of the tooth. Arm 10 of the blocking member rests against a stop pin 63.

Figure 10:
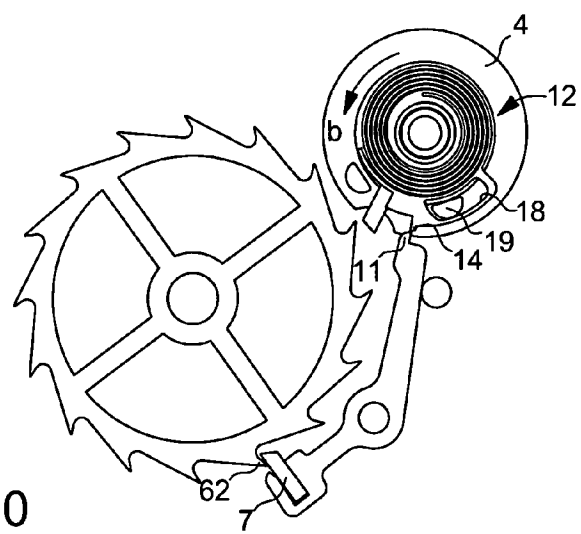

Continuing its travel in the direction of arrow b, roller 4 has made second actuating finger 14 of spiral spring 12 pass above first finger 11 of blocking member 6 and thus move around it, as is visible in FIG. 10. This climb is made possible due to the configuration of fingers 11 and 14 respectively showing humps 64 and 65 (see particularly FIG. 1). Spiral spring 12 is slightly squashed towards the top of FIG. 10 and it can be see that pin 19 touches the bottom of aperture 18.

Figure 11:
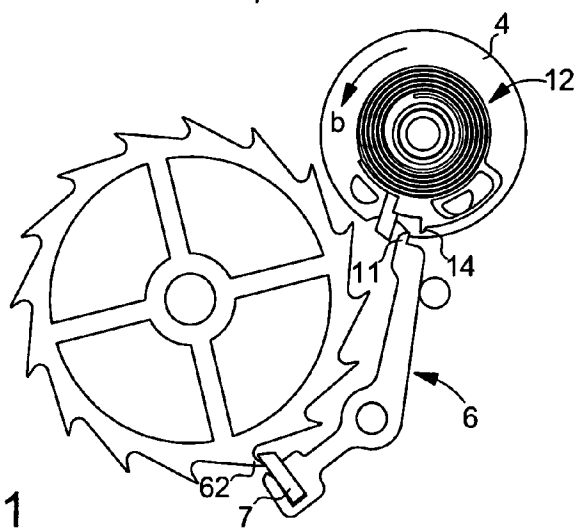

Finally FIG. 11 shows the position of roller 4 just before the end of the second vibration, almost at the dead point. Roller 4 will reverse its direction and second finger 14 of spiral spring 12 will again be able to drive first finger 11 of blocking member 6. A new cycle can then start which returns us to FIG. 4.

The second embodiment of the invention made in accordance with a first variant is illustrated in FIGS. 12 to 15. The detent escapement includes an escapement wheel 2 fitted with teeth 3. As is known and it is unnecessary to show, escapement wheel 2 is driven by the gear train of the watch which receives its driving force from the barrel. FIGS. 12 to 15 show a roller 4 mounted on a balance pin that is not shown. Roller 4 is provided with a pallet stone 5 receiving impulses via teeth 3 of wheel 2. This roller also carries a first finger 30. The escapement also includes a blocking member in the form of a lever 6 hinged on a pin 8. This blocking member includes a first arm 9 carrying a locking pallet stone 7 cooperating with teeth 3 of wheel 2. The blocking member or lever 6 includes an elastic member 32. This elastic member 32 carries a second actuating finger 31, which is arranged so as to be driven by first finger 30 when roller 4 rotates in a first direction a to actuate blocking member 6, and so as to move around, without being driven, first finger 30 when roller 4 rotates in a second direction b opposite to the first.

As was already noted hereinbefore, this second embodiment differs from the first embodiment in that the elastic member is no longer arranged on the roller, but on the blocking member, the originality of the invention residing in the elastic member enabling a watch of small dimensions, for example a wristwatch, to be fitted with a detent escapement. This is possible if the elastic member is a serpentine shape spring 32 or serpentine spring. Here again, it is thus a spring of great length, which is very flexible and which requires a minimum of effort from the balance that actuates it. "Serpentine spring" means a sinuous, corrugated spring folded over itself several times and which can take the shape shown in the drawing but also a different shape.

Figure 12:
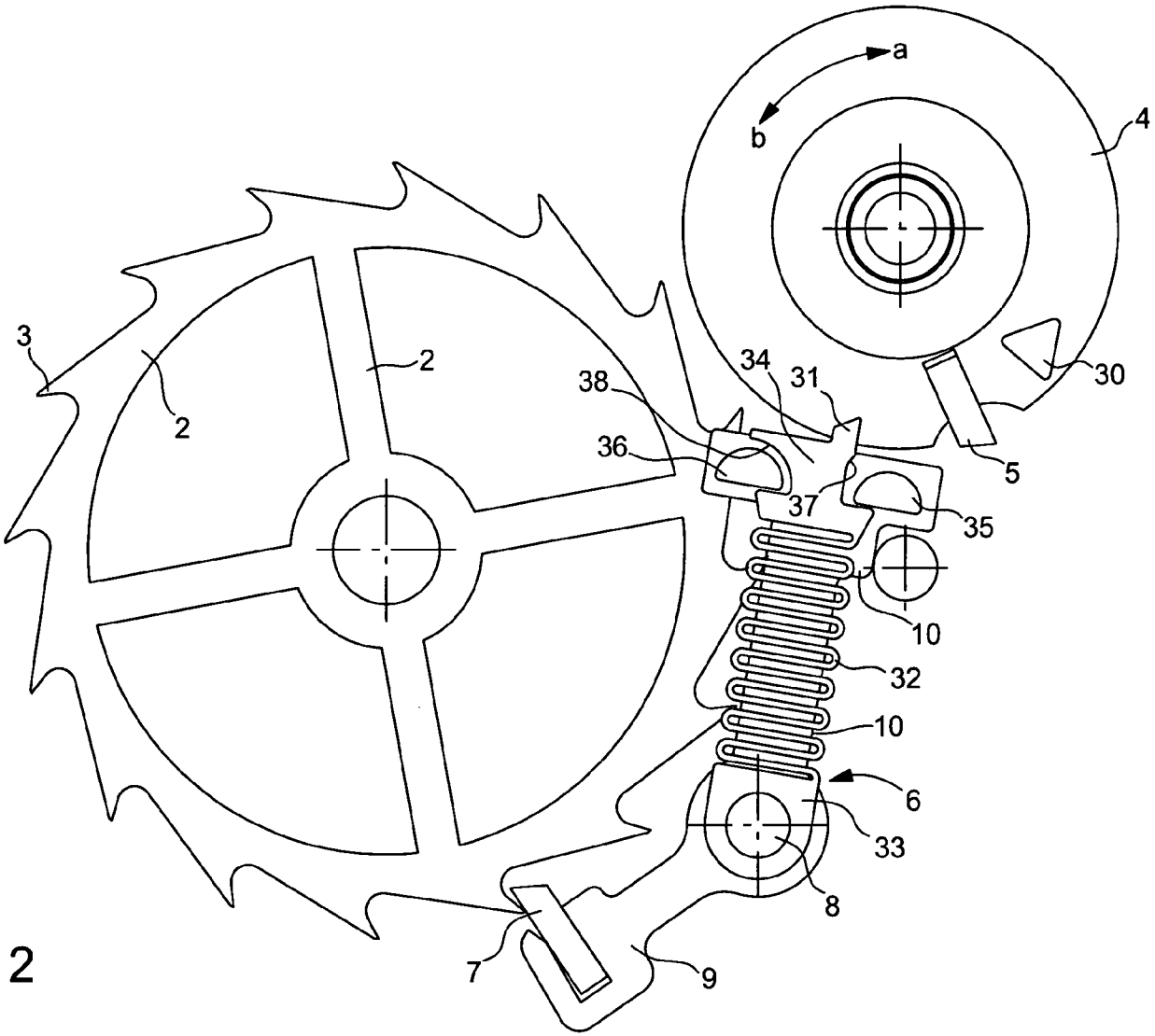
FIG. 12 is a plan view of the second embodiment of the invention made in accordance with a first variant.
Figure 13:
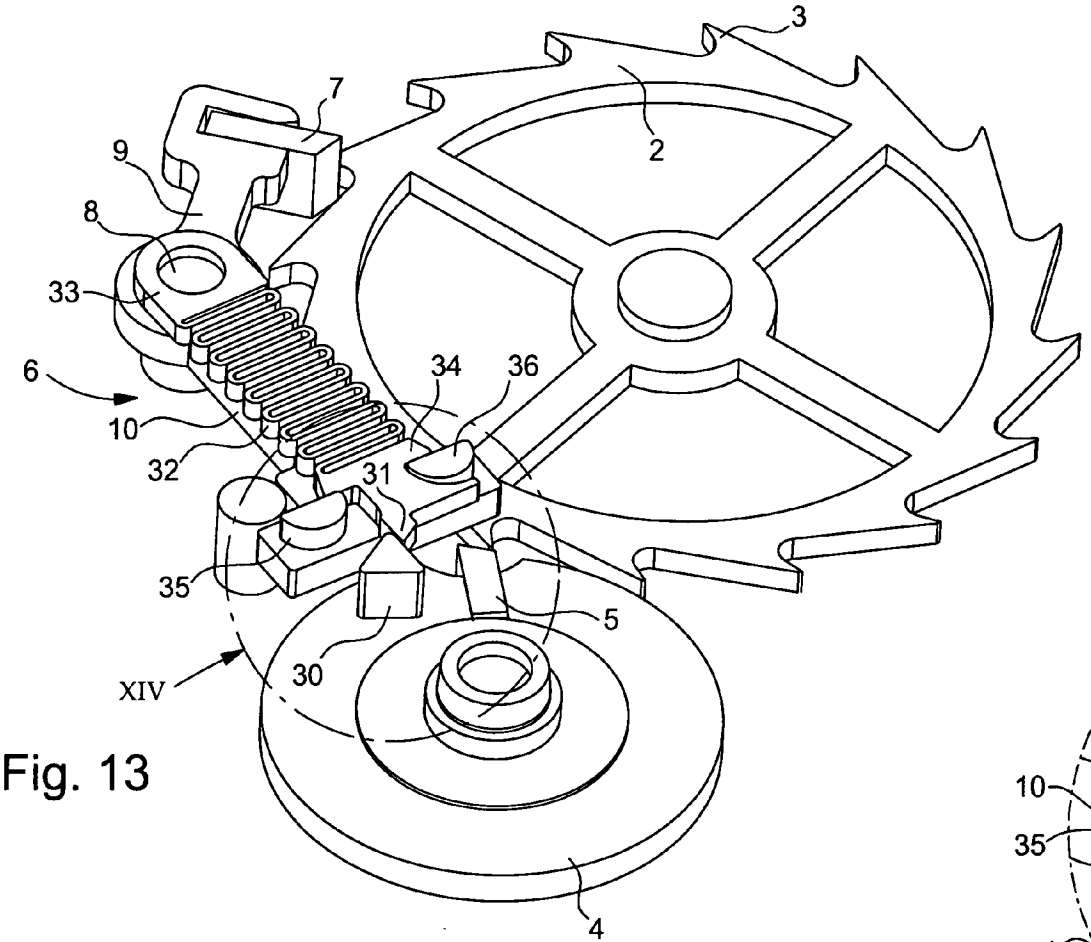
FIG. 13 is a perspective view of the embodiment shown in FIG. 12.
Figure 14:
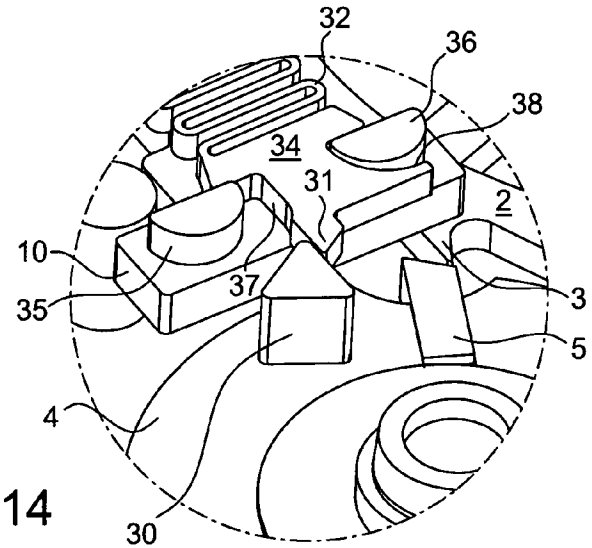
FIG. 14 is an enlargement of zone XIV of FIG. 13.

As shown in FIGS. 12 to 14, the serpentine spring 32 is added to second arm 10 of blocking member 6. The first end 33 of said spring is fixed to hinge pin 8 of blocking member 6. Second actuating finger 31 emerges in the area of the second end 34 of this spring.

The same FIGS. 12 to 14 show that the second end 34 of serpentine spring 32 and the second arm 10 of blocking member 6 includes retaining means able to limit the shake of said second finger 31 and to keep serpentine spring 32 within limits enabling second finger 31 to be driven by or respectively move around the first finger 30 carried by roller 4. Several retaining means can be envisaged, for example those which will be described now by way of example.

FIGS. 12 to 14 show that second arm 10 of blocking member 6 carries first and second pins 35 and 36. The second end 34 of serpentine spring 32 includes, in order and towards escapement wheel 2, a first notch 37 in which first pin 35 is engaged, second actuating finger 31, and a second notch 38 in which second pin 36 is engaged.

The detent escapement that has just been described in accordance with its second embodiment operates in the same way as the explained with reference to FIGS. 4 to 11 relating to the first embodiment. It is thus unnecessary to return to this here.

Figure 15:
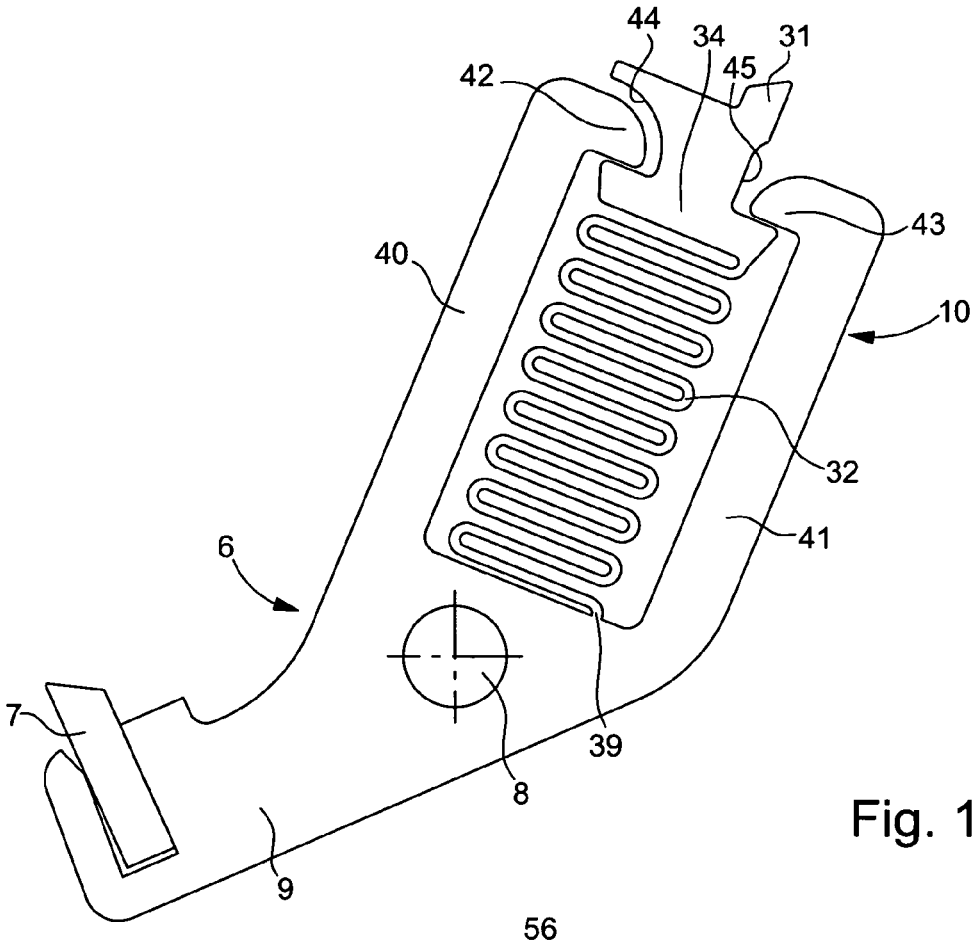
FIG. 15 shows a particular embodiment of the lever forming part of the escapement made in accordance with the first variant illustrated in FIG. 12.

Serpentine spring 32 described hereinbefore is an added part, added onto second arm 10 of blocking member 6. However, this spring could form part of the blocking member without being added thereto afterwards. FIG. 15 shows a blocking member or lever 6 made differently. In this embodiment, the coil spring is integral with second arm 10 of blocking member 6. The Figure shows in particular that the first end 39 of the coil spring is made out of the material of which second arm 10 of blocking member 6 is made and that the second actuating finger emerges from the area of the second end 34 of serpentine spring 32.

As was stated with reference to the serpentine spring added to the blocking member (FIGS. 12 to 14), FIG. 15 shows that the second end 34 of serpentine spring 32 and second arm 10 of blocking member 6 include retaining means able to limit the shake of second finger 31. FIG. 15 also shows that second arm 10 of blocking member 6 is formed of first and second levers 40 and 41, between which said spring is located. The retaining means include first and second beaks 42 and 43, which extend respectively said first and second levers 40 and 41. End 34 of the serpentine spring 32 includes, in order and in the direction of the escapement wheel, a first notch 45 in which second beak 43 is engaged, second finger 31 and a second notch 44 in which first beak 42 is engaged.

This blocking member 6, integral with serpentine spring 32 and retaining means 42, 44; 43, 45 limiting the shake of second actuating finger 31, opens up interesting manufacturing possibilities implementing for example galvanic growth, chemical or physical etching, or injection methods.

Figure 16:
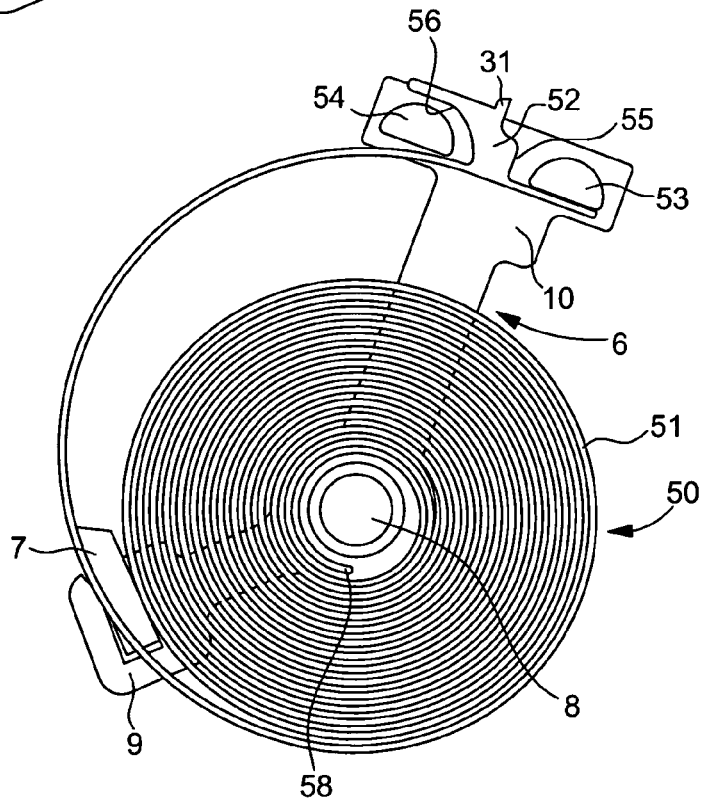
FIG. 16 shows a particular embodiment of the lever forming part of the escapement made in accordance with the second embodiment as a second variant.

This description will end with a second variant of the second embodiment. This variant is shown in FIG. 16. The drawing is limited to blocking member 6, the other components of the escapement being similar to those shown in FIGS. 12 to 14.

The detent escapement partially illustrated in FIG. 16 differs from that illustrated in FIGS. 12 to 14 in that elastic member 50 is a spiral spring 51.

Spiral spring 51 can be mounted on blocking member 6 in different ways. One way is shown in FIG. 16. Spiral spring 51 is mounted coaxially to pin 8 on which blocking member 6 is hinged. Inner end 58 of spiral spring 51 is secured to hinge pin 8. The second actuating finger 31 emerges in the area of second end 52 of spiral spring 51.

In a similar manner to that described hereinbefore, second end 52 of spiral spring 51 and second arm 10 fitted to blocking member 6 include retaining means able to limit the shake of second finger 31 and to keep the spiral spring within limits enabling the second actuating finger 31 to be driven by, or respectively, to move around the first finger 30 carried by roller 4.

As FIG. 16 shows, these retaining means include first and second pins 53 and 54 carried by second arm 10 of blocking member 6, these first and second pins being engaged respectively in first and second notches 55 and 56 which carry second end 52 of spiral spring 51.

In conclusion, it will be noted that all of the embodiments described hereinbefore are example embodiments which can be disregarded, the essential point residing in the fact that a spring of great length is used. Another embodiment could consist in fitting a serpentine spring to roller 4.

What is claimed is:

1. A detent escapement for a timepiece including an escapement wheel fitted with teeth, a roller secured to a balance, said roller being fitted with an impulse pallet stone, a blocking member in the form of a lever hinged on a pin, the first and second arms of said lever respectively carrying a locking pallet stone and a first actuating finger, and an elastic member mounted on the roller and carrying a second actuating finger capable of driving the first finger when the roller rotates in a first direction to actuate the blocking member and to move around said first finger without driving it, when the roller rotates in a second direction opposite to the first, wherein the elastic member is a spring including a plurality of turns wounded about a centre.

2. The escapement according to claim 1, wherein the spring is a spiral spring.

3. The escapement according to claim 2, wherein the spiral spring is mounted coaxially to a pin which carries the roller and the balance, the inner end of said spiral spring being fixed to said pin, said second actuating finger emerging in the area of the outer end of said spiral spring.

4. The escapement according to claim 3, wherein the outer end of the spiral spring and the roller include retaining means able to limit the shake of said second finger and to keep said spiral spring within limits enabling said second finger to drive or respectively move around said first finger carried by the blocking member.

5. The escapement according to claim 4, wherein the retaining means include first and second pins carried by the roller and wherein the outer end of the spiral spring includes in order and in the direction of its end, an opening in which the first pin is engaged with play, said second finger and an end tongue capable of abutting against the second pin.

6. A detent escapement for a timepiece including an escapement wheel fitted with teeth, a roller secured to a balance, said roller being fitted with an impulse pallet stone and a first finger, a blocking member in the form of a lever hinged on a pin, a first arm of said lever carrying a locking pallet stone, said lever including an elastic member carrying a second actuating finger capable of being driven by the first finger when the roller rotates in a first direction to actuate the blocking member, and to move around said first finger without driving it when the roller rotates in a second direction opposite to the first, wherein the elastic member is a serpentine spring.

7. The escapement according to claim 6, wherein the serpentine spring is added onto the second arm of the blocking member, the first end of the serpentine spring being fixed to the hinge pin of the blocking member, said second actuating finger emerging in the area of the second end of said serpentine spring.

8. The escapement according to claim 7, wherein the second end of the serpentine spring and the second arm of the blocking member include retaining means able to limit the shake of said second finger and to keep said serpentine spring within limits enabling the second actuating finger to be driven by, or respectively to move around the first finger carried by the roller.

9. The escapement according to claim 8, wherein the retaining means include first and second pins carried by the second arm of the blocking member and wherein the second end of the serpentine spring include in order and in the direction of the escapement wheel a first notch in which the first pin is engaged, said second finger, and a second notch in which the second pin is engaged.

10. The escapement according to claim 6, wherein the serpentine spring is integral with the second arm of the blocking member, the first end of the serpentine spring being made of the material of which the second arm of the blocking member is made, the second actuating finger emerging in the area of the second end of said serpentine spring.

11. The escapement according to claim 10, wherein the second end of the serpentine spring and the second arm of the blocking member include retaining means able to limit the shake of said second finger, and to keep said serpentine spring within limits enabling the second actuating finger to be driven by, or respectively to move around the first finger, carried by the roller.

12. The escapement according to claim 11, wherein the second arm of the blocking member is formed of first and second levers between which the serpentine spring is located, wherein the retaining means include first and second beaks respectively extending said first and second levers and wherein the second end of the serpentine spring includes, in order and in the direction of the escapement wheel, a first notch in which the second beak is engaged, said second finger and a second notch in which the first beak is engaged.

13. A detent escapement for a timepiece including an escapement wheel fitted with teeth, a roller secured to a balance, said roller being fitted with an impulse pallet stone and a first finger, a blocking member in the form of a lever hinged on a pin, a first arm of said lever carrying a locking pallet stone, said lever including an elastic member carrying a second actuating finger capable of being driven by the first finger when the roller rotates in a first direction, and to move around said finger without being driven when the roller rotates in a second direction opposite to the first, wherein the elastic member is a spiral spring.

14. The escapement according to claim 13, wherein the spiral spring is mounted coaxially to the pin on which the lever is hinged, the inner end of said spiral spring being fixed to said pin, said second actuating finger emerging in the area of the second end of said spiral spring.

15. The escapement according to claim 14, wherein the second end of the spiral spring and the second arm with which the blocking member is fitted, include retaining means able to limit the shake of said second finger and to keep said spiral spring within limits enabling the second actuating finger to be driven by, or respectively move around the first finger carried by the roller.

16. The escapement according to claim 15, wherein the retaining means include first and second pins carried by the second arm of the blocking member and wherein the second end of the spiral spring includes, in order and in the direction of the escapement wheel, a first notch in which the first pin is engaged, said second finger, and a second notch in which the second pin is engaged.

* * * * *